United States Patent [19]

Motta

[11] Patent Number: 5,007,169

[45] Date of Patent: Apr. 16, 1991

[54] VIBRATING RAZOR

[75] Inventor: Vincent C. Motta, West Norwalk, Conn.

[73] Assignee: Warner-Lambert Company, Morris Plains, N.J.

[21] Appl. No.: 448,779

[22] Filed: Dec. 11, 1989

[51] Int. Cl.[5] ..... B26B 19/28; B26B 19/02; B26B 21/14

[52] U.S. Cl. ..... 30/45; 30/43.92; 30/77

[58] Field of Search ..... 30/32, 42, 43, 44, 45, 30/48, 50, 77, 84, 43.92

[56] References Cited

U.S. PATENT DOCUMENTS

| | | | |
|---|---|---|---|
| 860,849 | 7/1907 | Bradshaw . | |
| 1,663,809 | 3/1928 | Moon . | |
| 2,040,683 | 5/1936 | Biniek . | |
| 2,042,293 | 5/1936 | Biniek . | |
| 2,054,418 | 9/1936 | Bohm . | |
| 2,319,815 | 5/1943 | Harshberger . | |
| 2,609,602 | 9/1952 | Harshberger . | |
| 3,324,545 | 6/1967 | Sali . | |
| 3,611,568 | 10/1971 | Alexander et al. . | |
| 3,636,627 | 1/1972 | Tiffin . | |
| 3,772,779 | 11/1973 | Douglass et al. . | |
| 4,083,102 | 4/1978 | Harshberger . | |
| 4,512,077 | 4/1985 | Tanabe et al. | 30/77 |
| 4,606,121 | 8/1986 | Diefenbach et al. | 30/43.92 |
| 4,631,825 | 12/1986 | Kuriyama et al. | 30/43.92 |
| 4,642,892 | 2/1987 | Ishida | 30/45 |
| 4,744,144 | 5/1988 | Lowery, Sr. et al. . | |
| 4,813,133 | 3/1989 | Locke et al. | 30/43.42 |
| 4,819,330 | 4/1989 | Fenn et al. . | |
| 4,845,847 | 7/1989 | Yasunaka et al. | 30/43.92 |

FOREIGN PATENT DOCUMENTS

| | | |
|---|---|---|
| 335526 | 4/1921 | Fed. Rep. of Germany . |

*Primary Examiner*—Douglas D. Watts
*Assistant Examiner*—Paul M. Heyrana, Sr.
*Attorney, Agent, or Firm*—Daniel A. Scola, Jr.; Richard S. Bullitt

[57] ABSTRACT

A vibrating razor having a shaver head adapted to receive a cartridge. The shaver head is pivotally attached to a housing containing a power source and an electric motor having a rotatable shaft. The shaver head is directly and eccentrically coupled to the rotatable shaft with an eccentric coupler for imparting oscillatory movement to the cartridge.

34 Claims, 4 Drawing Sheets

VIBRATING RAZOR

The present invention is directed to a razor and, more particularly, to a razor which is adapted to movably support a cartridge.

BACKGROUND

Razors adapted to movably support a blade or a disposable cartridge, commonly referred to as vibrating razors, are well known. Various mechanical arrangements have been devised for causing the rapid movement of the entire razor, a shaving head holding a disposable cartridge, or only a razor blade mounted on or within the razor. Typically, the blade or cartridge is disposed on a support to which movement is imparted.

Early versions of vibrating razors tended to be cumbersome and required external drive sources to impart movement to the blades or blade supports.

One well-known arrangement, herein referred to as the "eccentric weight" type razor, incorporates a weight which is eccentrically mounted on a rotating shaft such as the shaft of an electric motor. The rapid rotation of the eccentrically mounted weight provides a generally elliptical movement to the entire razor. In this type of razor, the entire razor, including the handle, moves in an elliptical path. It is actually the inability of the person holding the razor to hold the razor still which results in movement of the blade during shaving.

Other types of vibrating razors impart a movement to a disposable cartridge or blade in a direction which is not parallel to the plane of the surface being shaved. An example of this type of vibrating razor is disclosed in U.S. Pat. No. 4,642,892 to Ishida. The Ishida razor drives the cartridge obliquely relative to the blade edge.

Many of the vibrating razors known in the art, including the "eccentric weight" type razors, do not impart movement directly to the blade or cartridge support. In such razors, the blade or cartridge is not positively or directly driven by the electric motor. Another example of a vibrating razor which does not directly impart movement to the cartridge support is shown in U.S. Pat. No. 4,819,330 to Fenn, et al. The Fenn razor comprises a hollow shaver head resiliently mounted on a handle. The hollow shaver head has a pivotally mounted weight disposed therein which is driven by an electric motor. When the motor is energized and the weight is caused to oscillate within the hollow shaver head, the shaver head rocks relative to the handle due to the inertia imparted by the oscillating weight. The shaver head of the Fenn patent is not directly driven by the electric motor and, therefore, could remain still relative to the handle while the electric motor continues to drive the pivotally mounted weight.

It would, therefore, be desirable to provide a self-contained vibrating razor wherein a motor directly imparts movement to a blade or disposable cartridge razor in a plane substantially parallel to the surface which is being shaved.

SUMMARY OF THE INVENTION

The present invention is directed to a vibrating razor which provides movement to a cartridge. In accordance with the present invention, a rotating shaft of an electric motor is directly coupled to a pivoting shaver head. The electric motor, including the rotating shaft, and the proximal end of the shaver head are disposed within a housing. Movement is provided to the shaver head by pivotally attaching a mid-portion of the shaver head to a distal portion of the housing and coupling the proximal end of the shaver head to the rotating shaft of the electric motor.

DETAILED DESCRIPTION

Figure 1:
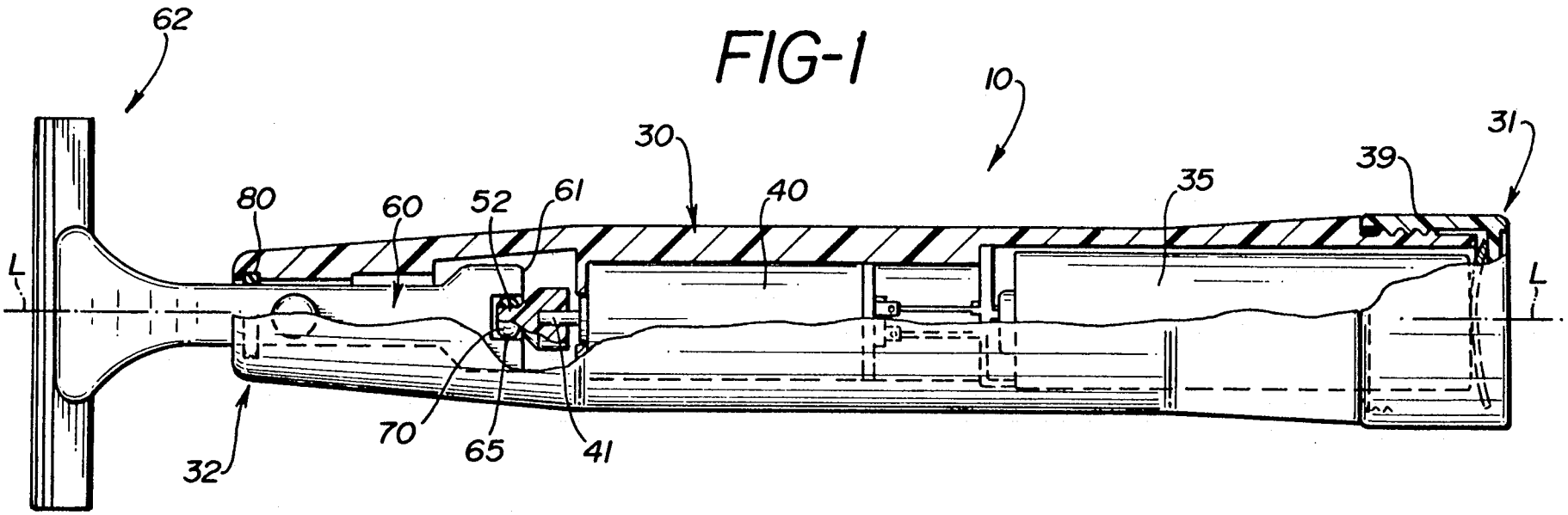
FIG. 1 is a top, partial cross-sectional view of one embodiment of the present invention with sections removed.
Figure 2:
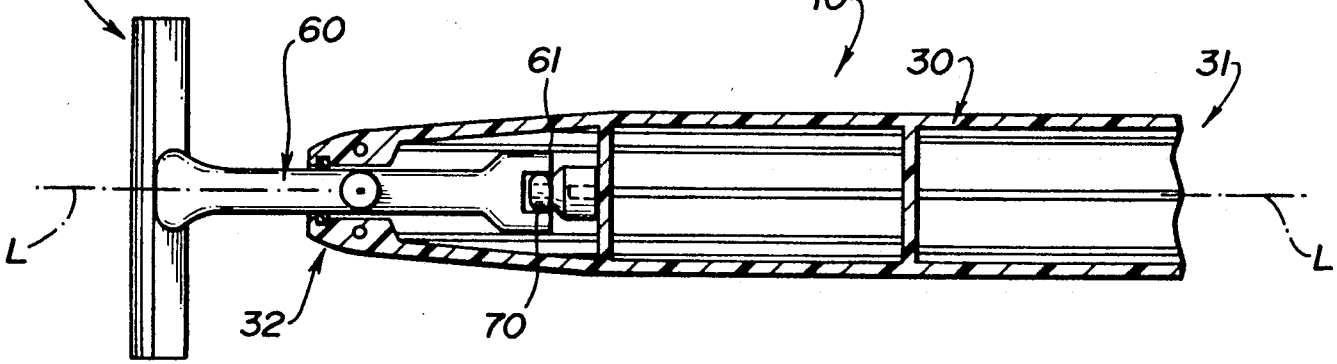
FIG. 2 is a top cross-sectional view of a portion of the vibrating razor of the present invention shown in FIG. 1.
Figure 3:
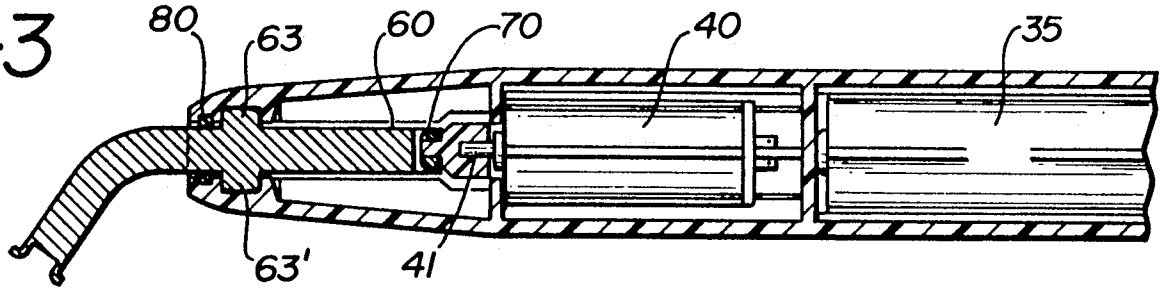
FIG. 3 is a side, cross-sectional view of a portion of the embodiment of the present invention shown in FIG. 1.

With reference to FIG. 1–3, which illustrate one embodiment of the present invention, the vibrating razor 10 comprises a housing 30 and a shaver head 60. As shown in FIG. 1, housing 30 has a proximal end 31, a distal end 32 and a longitudinal axis L. The shaver head 60 also has a proximal end 61 and a distal end 62. The distal end 62 of shaver head 60 is adapted to securely support a cartridge while the proximal end 61 comprises a slot 65 adapted to rotatably receive a drive pin 52 and bearing 70 as described below.

Disposed within the housing 30 is a power source 35, e.g. a 1.5 volt AA battery, which is in electrical communication with an electric motor 40. Power source 35 is preferably rechargeable either in an external recharger or within housing 30 by providing suitable electrical contacts (not shown) through the housing 30. It will be appreciated by those skilled in the art that a suitable switch, such as a magnetically actuated reed switch, (not shown) may be provided at any desired location to control the actuation of the electric motor 40 by completing the electrical circuit between the electric motor 40 and power source 35. Housing 30 is provided with a threaded end cap 39 to facilitate the removal of power source 35. End cap 39 may also be attached to housing 30 in other ways, e.g. a bayonet-type engagement.

Electric motor 40 has a shaft 41 which rotates upon the actuation of the electrical switch. While the speed of rotation can vary within wide limits without departing from the scope of the present invention, motor 40, for example, may be designed to rotate at about 9,000–10,000 rpm.

Figure 4:
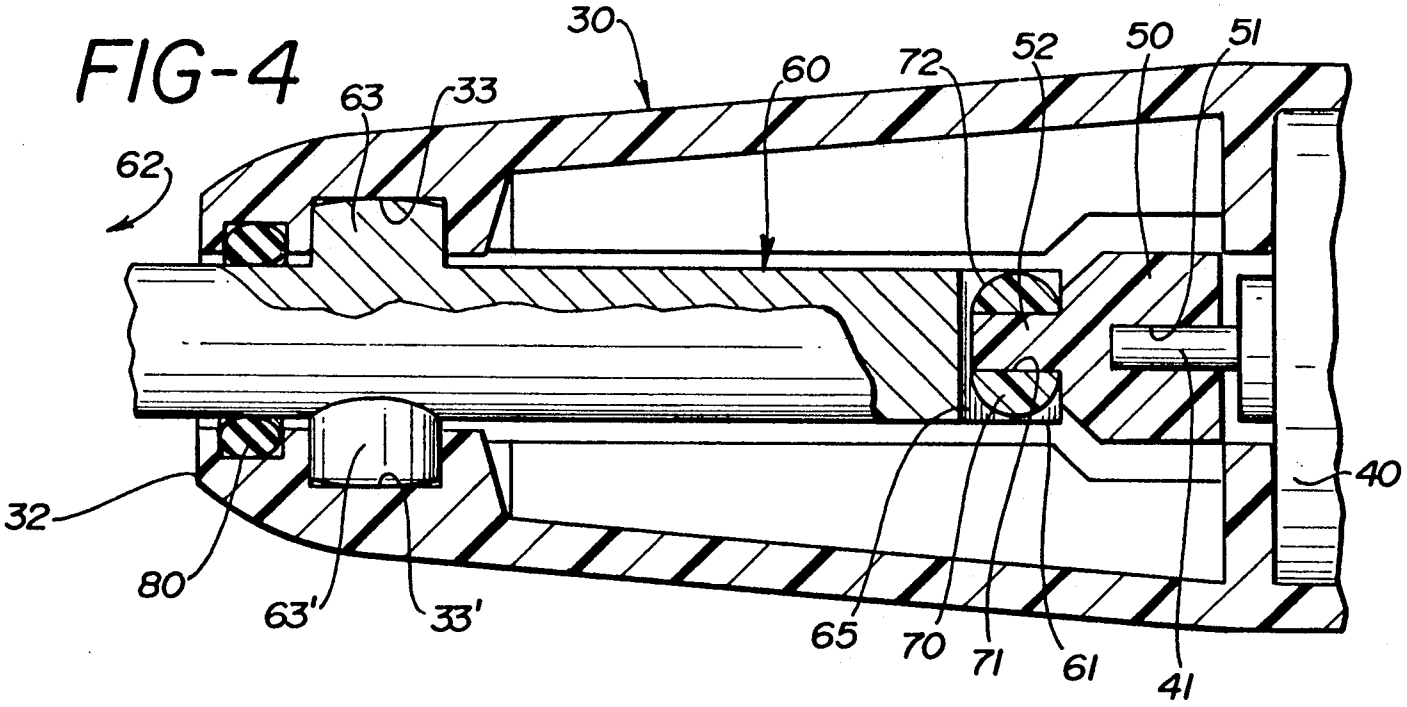
FIG. 4 is a side, cross-sectional view of a portion of the embodiment of the present invention illustrated in FIG. 3.
Figure 7:
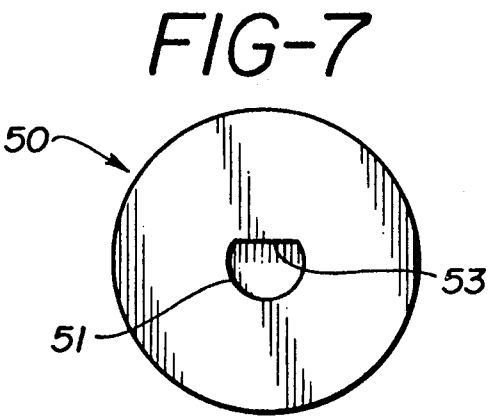
FIGS. 5–7 are left-end, side and right-end views, respectively, of a coupling member of one embodiment of the present invention.
Figure 6:
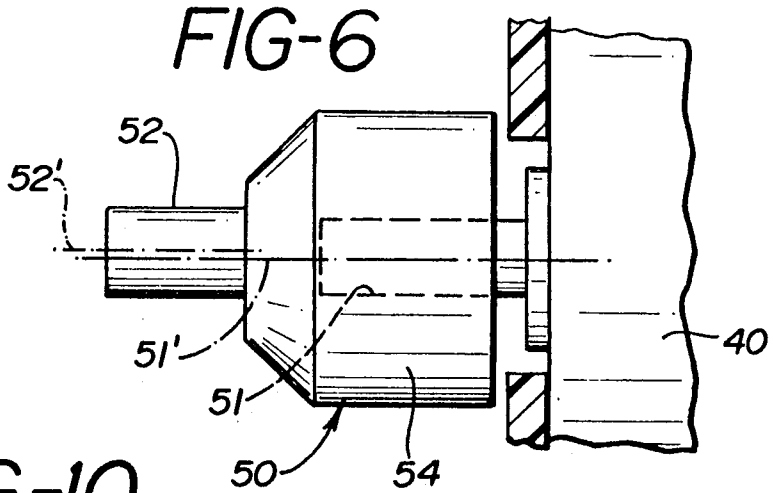
Figure 5:
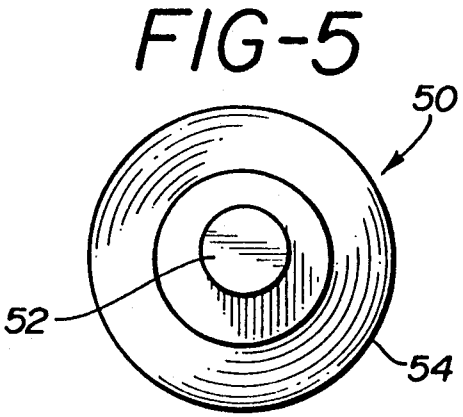

With reference to FIGS. 4–8, an eccentric coupler 50 having a proximal recess 51 and a drive pin 52 is disposed on the distal end of the shaft 41. The eccentric coupling engagement between shaft 41 and eccentric coupler 50 is best illustrated in FIGS. 5–7, wherein FIG. 5 is a left-end view, FIG. 6 is a side view and FIG. 7 is a right-end view of the eccentric coupler 50.

With reference to FIG. 6, eccentric coupler 50 has a proximal recess 51 with a longitudinal axis 51' and a drive pin 52 with a longitudinal axis 52'. Longitudinal axis 51' of proximal recess 51 is not colinear with, and is preferably offset and parallel to, the longitudinal axis 52' of drive pin 52. This eccentric arrangement is advantageously utilized to impart motion to shaver head 60 in a manner described below. When longitudinal axis 51' of proximal recess 51 is parallel to longitudinal axis 52' of drive pin 52, the offset distance, i.e., the distance between the respective axes, is about 0.002–0.03 inches and preferably about 0.005–0.01 inches. As best illustrated in FIG. 5, in this embodiment of the present invention, the drive pin 52 of eccentric coupler 50 is also disposed eccentrically with respect to the body 54 of eccentric coupler 50 since body 54 has the same central longitudinal axis 51' as proximal recess 51.

As shown in FIG. 7, while proximal recess 51 may be generally cylindrical, it is preferably provided with at least one flat surface 53 which extends axially in recess 51. The flat surface 53 may extend the entire length of recess 51 or for only a portion of the length of recess 51. In this preferred embodiment of the present invention, the shaft 41 of electric motor 40 has a cross section which corresponds to the cross section of the opening to recess 51 and is most preferably of such dimensions to provide an interference fit between the shaft 41 and proximal recess 51 of the eccentric coupler 50. It will be appreciated by those skilled in the art that in this preferred embodiment, the risk of undesirable relative rotation between shaft 41 and eccentric coupler 50 is eliminated.

With reference again to FIG. 4 which illustrates the pivotal relationship between the shaver head 60 and the housing 30, shaver head 60 comprises pivot protrusions 63, 63' disposed between the proximal end 61 and distal end 62 of shaver head 60. The protrusion members 63, 63' are pivotally received within corresponding recesses 33 and 33' of housing 30. The engagement between the pivot protrusion 63, 63' and recesses 33, 33' provides support for shaver head 60 while permitting substantially lateral movement of proximal end 61 and distal end 62 relative to housing 30. In accordance with the illustrated embodiment, the lateral movement of distal end 62 of shaver head 60 is restricted to primarily "slicing" motion within a plane substantially parallel to the shaving surface, i.e. substantially perpendicular to the axis of the hair being shaved and across the hair as opposed to downwardly through the hair. In this embodiment of the present invention, the vibrating razor 10 is not designed to provide "chopping" motion, i.e. downward movement which would cut through the hair absent movement of the entire vibrating razor relative to the surface being shaved.

In order to provide a fluid-tight seal between the housing member 30 and the shaver head 60, a seal 80 is advantageously disposed between shaver head 60 and housing member 30 at a position between recesses 33, 33' and the distal end 32 of housing member 30. Seal 80 may comprise, for example, a rubber 0-ring or other suitable material which provides a fluid-tight seal and prevents water, soap, hair and other debris from entering the interior of the housing member 30.

In order to provide a more secure, wear-resistant engagement between the drive pin 52 of eccentric coupler 50 and the proximal end 61 of shaver head 60, a bearing 70 is advantageously provided for the slot 65 of shaver head 60 (See FIG. 4). Bearing 70 has a central recess 71 which is large enough to permit rotational movement of the drive pin 52 relative to the bearing 70. Bearing 70 advantageously has a rounded outer edge 72 which permits angular relative motion between the slot 65 and drive pin 52. Bearing 70 may be formed of any suitable wear-resistant material, such as metal or a polymeric material.

Figure 9:
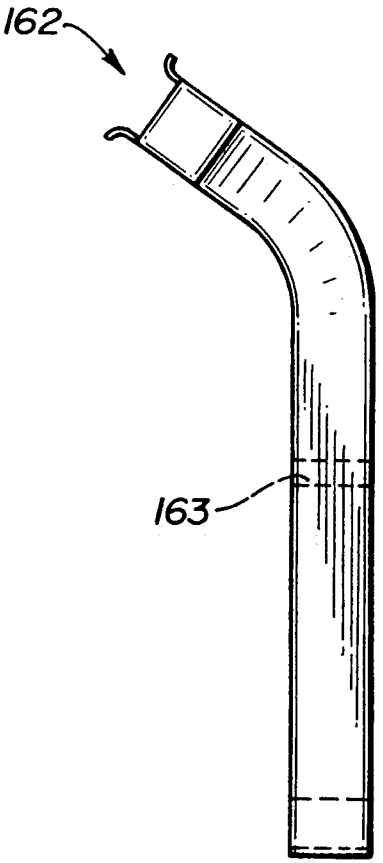
FIG. 9 is a side view of the shaver head illustrated in FIG. 8.
Figure 8:
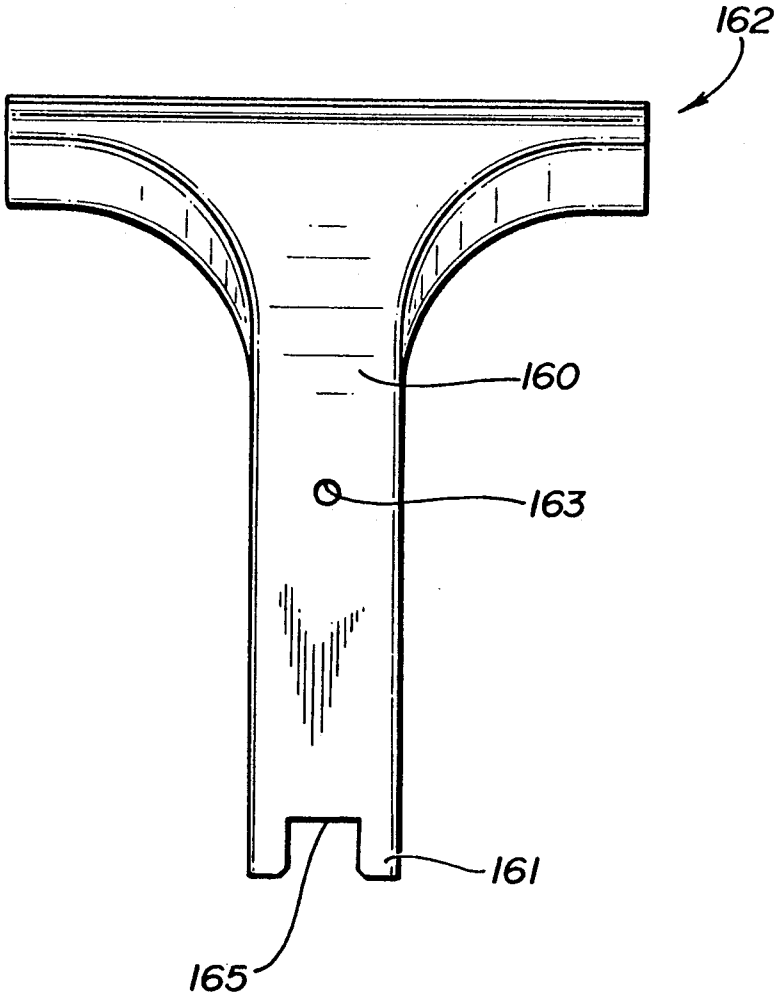
FIG. 8 is a top view of a shaver head of a second embodiment of the present invention.

With reference to FIGS. 8 and 9 which illustrate a second embodiment of the present invention, shaver head 160 is provided with a central bore 163. The positioning and operation of shaver head 160 is identical to that of the shaver head 60 described above, except that the shaver head 160 of this embodiment does not have pivoting protrusions as described above. Instead, shaver head 160 has a central bore 163 which is adapted to receive a pin (not shown) to pivotally secure shaver head 160 to the housing member. It will be appreciated by those skilled in the art that the pin which passes through all or a portion of central bore 163 may be formed as an integral part of the housing member or as a separate element. The distal end 162 of shaver head 160 is designed to receive a disposable cartridge in the same manner as the shaver head 60 described above.

Figure 10:
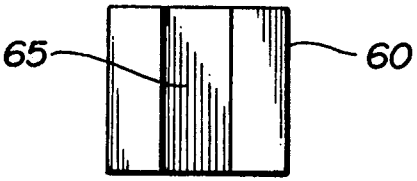
FIG. 10 is a proximal end view of the shaver head illustrated in FIG. 8.

FIG. 10 is a proximal end view of a shaver head of the first or second embodiments described above. The shape of slot 65 is important to the present invention since the movement of drive pin 52 and bearing 70 within slot 65 controls the path of the moving cartridge. When the motor 40 is engaged thereby rotating eccentric coupler 50, each point on drive pin 52 moves in a circular path. The circular path comprises motion in both the horizontal and vertical directions. By altering the shape of slot 65, the direction of the force imparted by drive pin 52 and bearing 70 to shaver head 60 can be controlled. For example, the slot 65 illustrated in FIG. 10 is substantially vertical allowing drive pin 52 and bearing 70 to move freely within slot 65 in the vertical direction but not the horizontal direction Since drive pin 52 and bearing 70 can move vertically freely, substantially no vertical forces are applied to shaver head 60 by drive pin 52. On the other hand, the horizontal movement of drive pin 52 is directly imparted to slot 65 of the shaver head 60 causing the shaver head 60 to move horizontally. In this manner, the movement of the cartridge on the distal end of the shaver head is substantially oscillatory. From this description, it will be appreciated by those skilled in the art that the path of movement of the distal end 62 of the shaver head 60 may be readily controlled by modifying the shape of slot 65 in the proximal end 61 of shaver head 60.

Figure 12:
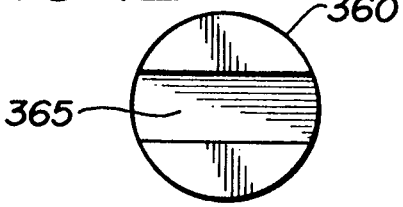
FIG. 12 is a proximal end view of a shaver head of a fourth embodiment of the present invention.
Figure 11:
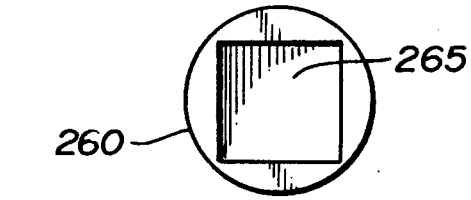
FIG. 11 is a proximal end view of a shaver head of a third embodiment of the present invention.

FIGS. 11 and 12 illustrate alternative embodiments of the present invention having slots 265, 365 of shaver heads. In the embodiment illustrated in FIG. 11, the slot 265 of a shaver head is provided with a substantially square groove. In this embodiment both the horizontal and vertical movements of the driving pin 52 are translated to the shaver head 260. It will be appreciated that the size of slot 265 (relative to the diameter and eccentricity of the drive pin) determines the amount of movement imparted to the shaver head. In the embodiment illustrated in FIG. 12, the slot 365 is disposed generally horizontally, therefore, only the vertical motion of the drive pin is imparted to the shaver head 360. In this embodiment, the movement of the cartridge is essentially in a "chopping" motion. From the description herein, it will be appreciated by those skilled in the art that a wide range of slice/chop ratios may be provided by modifying the configuration of the slot 65 in the proximal end of the shaver head 60. If the shaver head is coupled to the drive pin in a manner which prevents any relative movement between the drive pin 52 and the shaver head 60, any given point on the distal end 62 of the shaver head 60 moves in a circular path.

It will be appreciated by those skilled in the art that the engagement between the shaver head and the housing may be modified to enhance the moveable support for a shaver head which moves in either a circular or generally vertically path. Such modification is readily provided by changing the pivot protrusions illustrated in FIG. 4 to a generally semi-spherical configuration with corresponding semi-spherical recesses in the housing member. Alternatively, the engagement between the shaver head and the housing member may be provided in a ball-and-socket arrangement.

Figure 13:
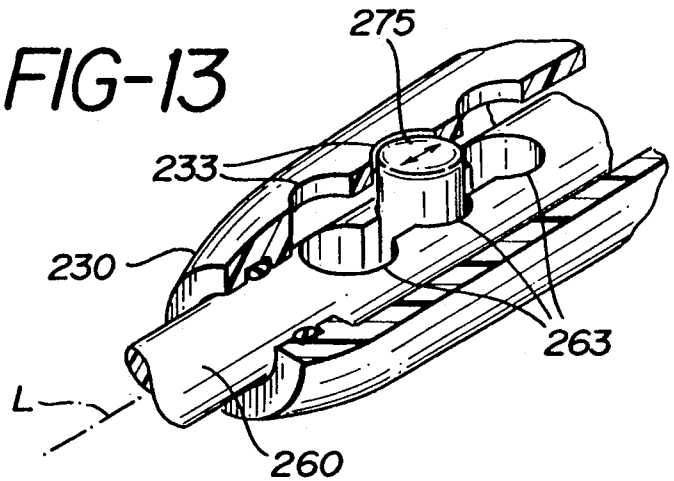
FIG. 13 is a perspective view with sections removed of a movable pivot member of a fifth embodiment of the present invention.

In accordance with a fifth embodiment of the present invention, the distance which the distal end of the shaver head moves may be varied by changing the position of the pivoting connection between the shaver head and the housing along the longitudinal axis L of the shaver head. As illustrated in FIG. 13, in this embodiment of the present invention, the housing 230 and the shaver head 260 are provided with longitudinal central recesses 233 and 263 having notches. The notches 233 and 263 are adapted to receive a slidable pin 275 which is movable axially along the longitudinal axis L of the razor relative to the housing 230 and shaver head 260. It will be appreciated by those skilled in the art that by moving the pivoting point of the shaver head 260 closer to the eccentric coupler and driving motor, each point on the distal end of the shaver head, and all points on a disposable cartridge disposed thereon, move a greater distance for the same amount of movement imparted to the proximal end of the shaver head. In this manner, the person shaving can selectively vary the extent of movement of the blade cartridge by simply moving slidable pin 275. Corresponding indicia may be provided on the housing member 230 to indicate that the positioning of the movable pin 275 will provide long, medium or short displacement of the cartridge.

As stated above, in accordance with all embodiments of the present invention, the shaver head is directly coupled with the rotatable shaft of the electric motor. As used herein, the terms "direct" and "directly" mean that rotation of shaft 41 of electric motor 40 necessitates movement of the shaver head 60 relative to the housing 30 regardless of the presence of other forces on the housing 30 or the shaver head 60. As used herein, the term "direct" is not used to mean that the drive pin and shaver head are in contact. The terms "direct" and "directly" are meant to exclude the indirect "drive" type arrangements discussed above and shown, for example, in U.S. Pat. Nos. 4,819,330 to Fenn, et al. and 3,636,627 to Tiffin wherein the motors and weights could move without movement of the shaver head relative to the housing.

What is claimed is:

1. An electric vibrating razor comprising:

an electric motor with a rotatable shaft;

a battery for powering said electric motor;

a substantially hollow handle which substantially encases said electric motor and said battery wherein said handle has a longitudinal axis;

a solid shaver head pivotally attached to said handle wherein said shaver head has a distal end with means for supporting a cartridge, and a proximal end;

means for coupling said proximal end of said shaver head to said rotatable shaft.

2. An electric vibrating razor according to claim 1 wherein said coupling means is an eccentric coupler.

3. An electric vibrating razor according to claim 2 wherein said eccentric coupler comprises a proximal recess with a longitudinal axis engage said rotatable shaft;

a drive pin with a longitudinal axis engage said proximal end of said shaver head; and wherein said longitudinal axis of said proximal recess is not collinear with said longitudinal axis of said drive pin.

4. An electric vibrating razor according to claim 3 wherein said drive pin is disposed at the distal end of said eccentric coupler.

5. An electric vibrating razor according to claim 3 wherein said proximal end of said shaver head comprises a slot movably receive said drive pin.

6. An electric vibrating razor according to claim 5 further comprising a bushing disposed in said slot.

7. An electric vibrating razor according to claim 6 wherein said bushing comprises metal.

8. An electric vibrating razor according to claim 3 wherein said longitudinal axis of said proximal recess is parallel to said longitudinal axis of said drive pin.

9. An electric vibrating razor according to claim 8 wherein said longitudinal axis of said proximal recess is offset to said longitudinal axis of said drive pin by about 0.002–0.03 inches.

10. An electric vibrating razor according to claim 8 wherein said longitudinal axis of said proximal recess is offset to said longitudinal axis of said drive pin by about 0.005–0.01 inches.

11. An electric vibrating razor according to claim 1 wherein said solid shaver head is disposed at least partially within said handle.

12. An electric vibrating razor according to claim 1 wherein said coupling means imparts substantially oscillatory motion to said shaver head.

13. An electric vibrating razor according to claim 1 wherein said proximal end of said shaver head comprises a slot adapted to receive at least a portion of said coupling means.

14. An electric vibrating razor according to claim 1 wherein said battery is rechargeable.

15. An electric vibrating razor according to claim 1 wherein the pivotal attachment of said shaver head and said handle is adjustable along said longitudinal axis of said handle.

16. An electric vibrating razor according to claim 1 further comprising a seal disposed between said shaver head and said handle.

17. A vibrating razor comprising:

a power source;

an electric motor having a rotatable shaft;

means for housing said power source and said electric motor;

means for supporting a cartridge wherein said supporting means has a distal end and a proximal end;

means for pivotally connecting said supporting means to said housing means; and means for directly coupling said rotatable shaft to said proximal end of said supporting means wherein said coupling means imparts movement to said supporting means relative to said housing means upon rotation of said rotatable shaft.

18. A vibrating razor according to claim 17 wherein said coupling means comprises an eccentric coupler which eccentrically couples said rotatable shaft to said proximal end of said supporting means.

19. A vibrating razor according to claim 17 wherein said coupling means imparts substantially oscillatory movement to said supporting means.

20. A vibrating razor according to claim 17 wherein said support means is solid.

21. A vibrating razor according to claim 17 wherein said proximal end of said supporting means comprises a slot movably receive at least a portion of said coupling means.

22. A vibrating razor according to claim 21 wherein said slot extends substantially vertically in said supporting means.

23. A vibrating razor according to claim 21 wherein said slot extends substantially horizontally in said supporting means.

24. A vibrating razor according to claim 17 wherein said coupling means comprises a proximal recess with a longitudinal axis adapted to engage said rotatable shaft;

a drive pin with a longitudinal axis engage said proximal end of said shaver head; and wherein said longitudinal axis of said proximal recess is not colinear with said longitudinal axis of said drive pin.

25. A vibrating razor according to claim 17 wherein said power source is rechargeable.

26. An electric vibrating razor comprising:

a power source;

an electric motor having a rotatable shaft;

means for housing said power source and said electric motor wherein said housing means has a longitudinal axis;

means for supporting a cartridge wherein said supporting means has a distal end and a proximal end;

means for pivotally connecting said supporting means to said housing means; and means for coupling said rotatable shaft to said proximal end of said supporting means wherein said coupling means is disposed entirely outside said supporting means.

27. An electric vibrating razor according to claim 26 wherein said coupling means directly couples said rotatable shaft with said proximal end of said supporting means.

28. A vibrating razor according to claim 26 wherein said coupling means comprises an eccentric coupler which eccentrically couples said rotatable shaft to said proximal end of said supporting means.

29. A vibrating razor according to claim 26 wherein said coupling means comprises a proximal recess with a longitudinal axis engage said rotatable shaft;

a drive pin with a longitudinal axis engage said proximal end of said shaver head; and wherein said longitudinal axis of said proximal recess is not collinear with said longitudinal axis of said drive pin.

30. A vibrating razor according to claim 26 wherein said supporting means is solid.

31. A vibrating razor according to claim 26 wherein said proximal end of said supporting means comprises a slot movably receive at least a portion of said coupling means.

32. An electric vibrating razor according to claim 31 further comprising a bushing disposed in said slot.

33. An electric vibrating razor according to claim 32 wherein said bushing comprises metal.

34. An electric vibrating razor according to claim 26 wherein said connecting means is moveable with respect to said housing means.

* * * * *